US005434584A

United States Patent [19]

Kelly

[11] Patent Number: 5,434,584

[45] Date of Patent: Jul. 18, 1995

[54] SUBMARINE COMMUNICATIONS SYSTEM

[75] Inventor: Francis J. Kelly, Adelphi, Md.

[73] Assignee: The United States of America as represented by the Secretary of the Navy, Washington, D.C.

[21] Appl. No.: 421,708

[22] Filed: Dec. 11, 1973

[51] Int. Cl.[6] ..... H01Q 1/34; H01Q 1/32; H01Q 7/08

[52] U.S. Cl. ..... 343/710; 343/712; 343/788

[58] Field of Search ..... 343/710, 712, 708, 788, 343/709, 719; 114/240 R; 325/28; 367/131

[56] References Cited

U.S. PATENT DOCUMENTS

| | | | |
|---|---|---|---|
| 1,395,454 | 11/1921 | Rogers | 343/710 |
| 3,110,282 | 11/1963 | Foerster | 114/240 R |
| 3,717,876 | 2/1973 | Volkers et al. | 343/788 |

*Primary Examiner*—Gregory Issing
*Attorney, Agent, or Firm*—Thomas E. McDonnell

[57] ABSTRACT

A low frequency submarine communication system which utilizes the submarine body as part of the antenna. The antenna is coiled around the submarine hull and utilizes the hull as the core for low frequency (below 1000 Hz) communication. The system allows communication with other vehicles below, on, or above the surface without impeding submarine operation (speed or depth) and the system greatly decreases chances of unwanted detection of the submarine.

4 Claims, 1 Drawing Sheet

SUBMARINE COMMUNICATIONS SYSTEM

BACKGROUND OF THE INVENTION

Undetected and unimpeded submarine communication with surface or above surface vehicles is a highly desired objective. Present methods require submarine performance which interfere with best operational depth and/or speed. Several of the present methods also entail a high degree of possible detection by unwanted sources.

Some types of electromagnetic radiation systems have been utilized from below the surface. However, these systems such as a trailing-wire or loop do not permit high power or low frequency signals, nor are they reliable due to their low power output. They also constrain the depth and speed of the submarine operation when communication is taking place.

Another system is to place an electromagnetic radiating element on the surface (connected of course to the submarine). This has several disadvantages, among them restriction on submarine speed and/or depth, the element takes several minutes to reach the surface; and the element can be detected on the surface giving away the submarine location.

Still a further system involves the use of laser, dye or smoke emission. These of course only work under good visibility and sea conditions and are of course visible to all-friend or foe, and of course beside the other constraints this method is not very effective in communicating with other submarines or to surface ships.

A low frequency communication system would present a significant advance over the above systems and is particularly desired because of the penetration through a medium (water) of the low frequency electromagnetic waves. However, low frequency communication has always been difficult because of the physical size requirements of the antenna structure. A successful method known to the prior art of generating low frequency waves (below 1000 Hz) has been the SANGUINE Project, which essentially employs the earth as a radiator. Simply stated, a grounded transmission line is placed over a huge rock deposit. Since the rock deposit usually has a relatively low conductivity, the transmission line forms an effective loop antenna many kilometers deep. Obviously, this loop is immmoveable and not of practical use on a submarine, but it shows the magnitude of the problem involved.

SUMMARY OF THE INVENTION

This problem is solved in the present invention by utilizing part or all of a submarine hull as the ferromagnetic core of a magnetic loop antenna. Insulated conducting wires are coiled around the hull and power is supplied from the propulsion or an auxiliary plant. Frequencies below 1000 HZ are used to penetrate the water.

Ferromagnetic steel and iron materials have a very high permeability and by utilizing these materials as the core (hull) the net magnetic field (B) generated for a given coil current may be increased a thousand times over a similar non-cored loop. Further, the total net magnetic field which may be generated is proportional to the mass of the core. Thus, by using an entire submarine as the core, a low frequency signal can be produced which is detectable at or above the surface and at good distances below the surface.

Thus, it is an object of the present invention to provide submarine communication with surface, above surface vehicles, and other below surface vehicles.

A second object of the present invention is to provide undetected submarine communications.

A third object of the present invention is to provide submarine communication which does not impede submarine speed or operating depth.

A fourth object of the present invention is to provide submarine communication at frequencies of less than 1000 Hz.

A further object of the present invention is to provide submarine communication with large power and permanent non-extending system.

Other objects, advantages and novel features of the invention will become apparent from the following detailed description of the invention when considered in conjunction with the accompanying drawings wherein:

DESCRIPTION OF THE PREFERRED EMBODIMENT

Figure 1:
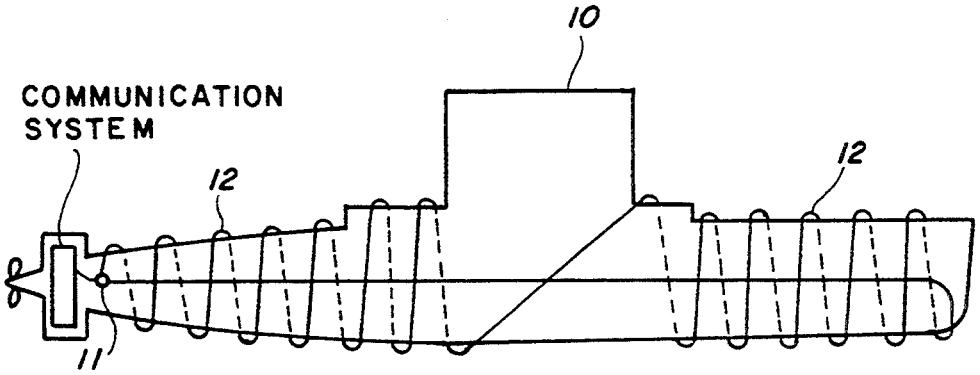
FIG. 1 illustrates a first embodiment of the invention.

Referring to FIG. 1, a submarine 10 is shown with insulated antenna wire 12 coiled radially around the hull. The antenna wire is connected to the submarine power plant through connector 11.

Figure 2:
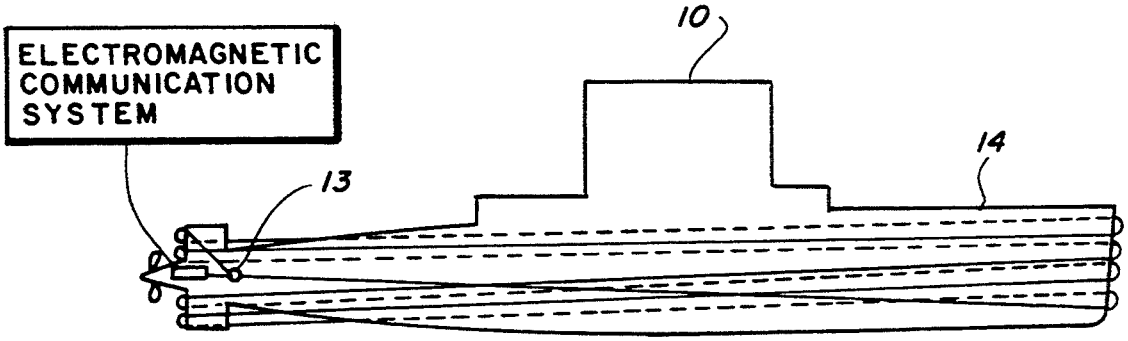
FIG. 2 illustrates a second embodiment of the invention.

Referring to FIG. 2, the submarine 10 is shown with the insulated antenna wire 14 coiled longitudinally around the hull. The antenna wire is connected to the power supply through connector 13.

During a communication exercise devices on board which utilize permanent magnets must be protected from the large magnetic field generated. For example, conventional motors, dynamos, compasses, and computer magnetic storage systems must all be shielded or protected from possible damage. The magnetic computer tapes and memory cores may be dumped onto crystal optical storage units during an exercise.

The power for the antenna systems may also be provided from a separate power plant or large storage batteries conventional in the submarine art.

Some alternate versions of the invention could utilize a ship, plane, or orbital vehicle as the core for the antenna.

Obviously many modification and variations of the present invention are possible in light of the above teachings. It is therefore to be understood that within the scope of the appended claims the invention may be practiced otherwise than as specifically described.

What is claimed is:

1. In a vehicle communication system the improvement comprising:

antenna means utilizing the vehicle body as a ferromagnetic loop antenna core for low frequency high power electromatnetic communication.

2. The system of claim 1, wherein:

said vehicle body is a submarine; and said antenna means is coiled around at least part of said submarine.

3. The system of claim 2, wherein:

said antenna is coiled radially around said submarine.

4. The system of claim 2, wherein:

said antenna is coiled longitudinally around said submarine.

* * * * *